United States Patent [19]

Riggs

[11] 4,043,093

[45] Aug. 23, 1977

[54] ARTICLE HOLDER FOR A SLOPING ROOF

[76] Inventor: Louis C. Riggs, 1705 Youngland, Shively, Ky. 40216

[21] Appl. No.: 697,459

[22] Filed: June 18, 1976

[51] Int. Cl.[2] ..... E04D 15/00

[52] U.S. Cl. ..... 52/749

[58] Field of Search ..... 52/749, 127, 748, 173 R, 52/27, 547; 248/301

[56] References Cited

U.S. PATENT DOCUMENTS

| | | | |
|---|---|---|---|
| 2,511,083 | 6/1950 | Small | 52/547 |
| 3,769,916 | 11/1973 | Hogan | 52/749 X |

*Primary Examiner*—Price C. Faw, Jr.
*Assistant Examiner*—Carl D. Friedman
*Attorney, Agent, or Firm*—Lowe, King, Price & Markva

[57] ABSTRACT

The device holds articles on a sloping roof and comprises a holding portion and an attaching portion. The holding portion has a structural configuration to contain the articles and the attaching portion is effective to fit between successive courses of roofing shingles fixed on the sloping roof. The attaching portion includes a bent end flange effective to hook downwardly over the top edge of the lower course of successive courses of shingles. The device has a first end section, a base end section, a back section, an insertion section and a second end section. Each of these sections are connected to each other by a series of bends in a single piece of material having five sections and four bends.

12 Claims, 7 Drawing Figures

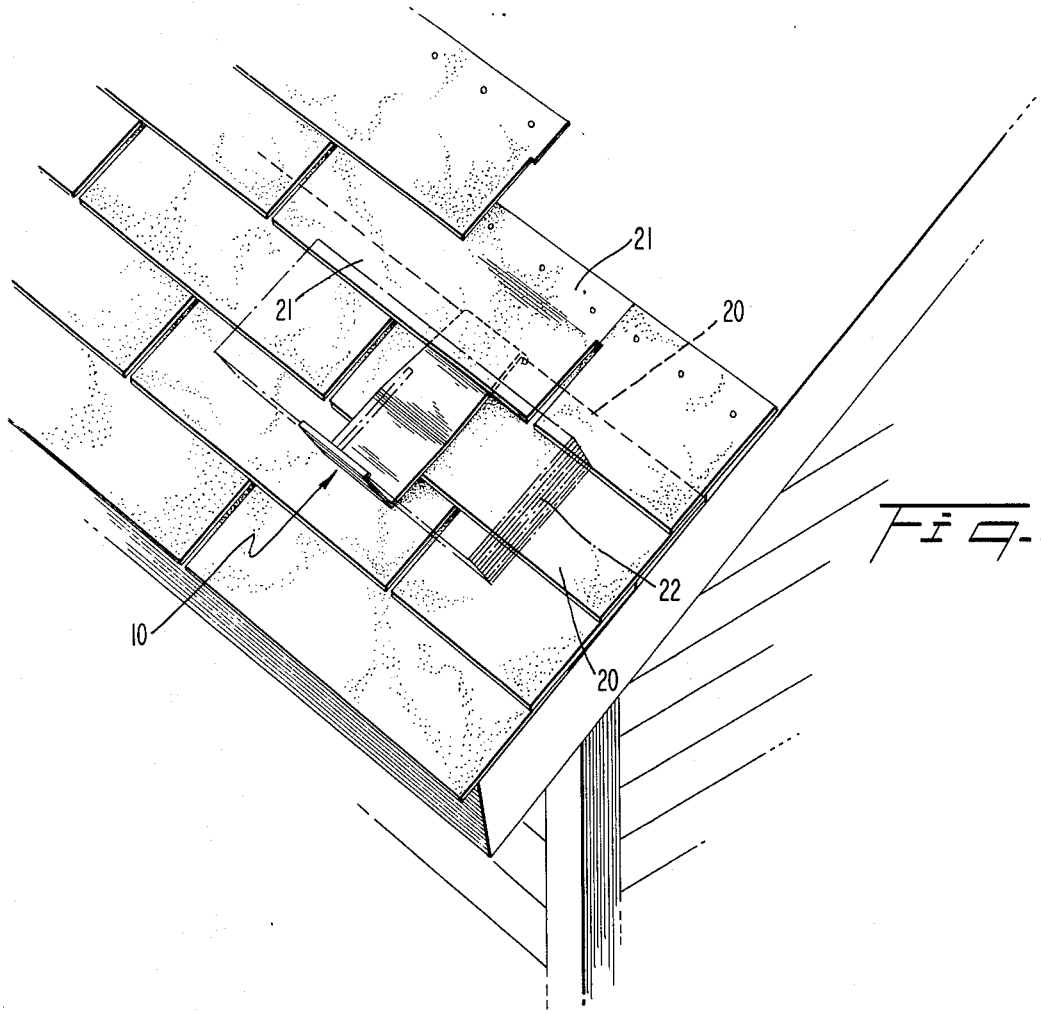
Fig. 1
Fig. 2
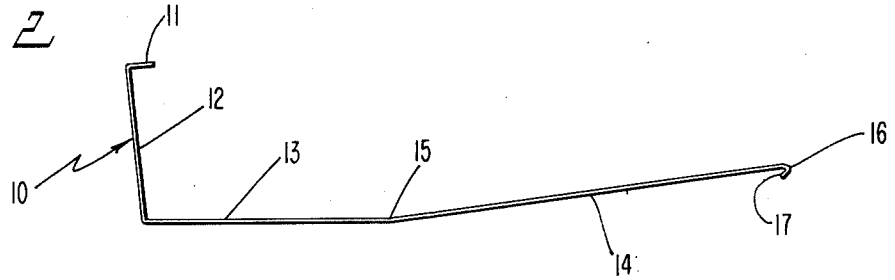
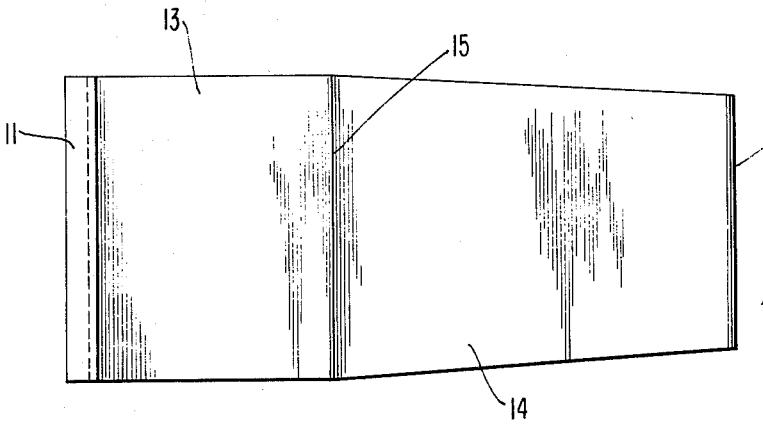
Fig. 3

INSERTION
ROOF LINE
RELEASE & RETRACT
10
11
12
13
14
15
16
17
20
21
22
A
B

ARTICLE HOLDER FOR A SLOPING ROOF

BACKGROUND OF THE INVENTION

This invention relates to a device for holding articles on a sloping roof. More particularly, the device is shaped to hold a bundle of shingles which are to be attached to the roof.

There are numerous devices available in the prior art for holding shingles and various other articles on a sloping roof. However, most of these incorporate various types of fastening mechanisms, levers and/or fastening means which attach the mechanism directly to the roof. The prior art devices are cumbersome to handle and involve operations taking unnecessary time.

PURPOSE OF THE INVENTION

The primary object of this invention is to provide a simply constructed device which may be easily inserted between successive courses of shingles attached to a sloping roof.

Another object of this invention is to provide a device which is effective to hold a sizable bundle of shingles without having to be fastened to the roof or to attached shingles by a fastening mechanism.

A further object of this invention is to have a device which may be easily inserted between successive courses of shingles fixed on the roof and released by a simple rocking operation.

SUMMARY OF THE INVENTION

These objects and other advantages are accomplished through the use of the device as described and disclosed herein. The device comprises a holding portion having a structural configuration to contain the articles desired to be held on a sloping roof. An attaching portion is effective to fit between successive courses of roofing shingles fixed to the roof. The attaching portion includes a bent end flange effective to hook downwardly over the top edge of the lower course of the successive courses of shingles.

In a specific embodiment of the invention, the attaching portion comprises a first flat section. The holding portion includes a second flat section connected to and at an angle along one edge of the first flat section forming a bend therebetween. The holding portion has an L-shaped cross section having a bottom base section for holding a stack of shingles and an end flange extending from the base section in a direction toward the other end of the device. The attaching portion comprises a flat section having a free top edge and the bent end flange is disposed at an angle of less than 90°. The bent end flange includes a cam surface facing the first flat section.

Even more specifically, the device is composed of a single, continous piece of material having five sections and four bends. A first bend connects a first end section to a base section. A second bend connects the base section to a back section. A third bend connects the back section to an insertion section. A fourth bend connects the insertion section to a second end section. The first end section comprises a pushing surface located on a flange connected to the base section. The second end section includes a cam surface facing toward the insertion section.

BRIEF DESCRIPTION OF DRAWINGS

Other objects of this invention will appear in the following description and appended claims, reference being made to the accompanying drawings forming a part of the specification wherein like reference characters designate corresponding parts in the several views.

FIG. 1 is a perspective view of a device made in accordance with this invention shown as used on a sloping roof, FIG. 2 is a side-elevational view of a device made in accordance with this invention, FIG. 3 is a top-elevational view of a device of FIG. 2, FIGS. 4*a* through 4*c* show the operation of a device made in accordance with this invention.

DESCRIPTION OF SPECIFIC EMBODIMENTS

Figures 4A, 4B, 4C, 5:
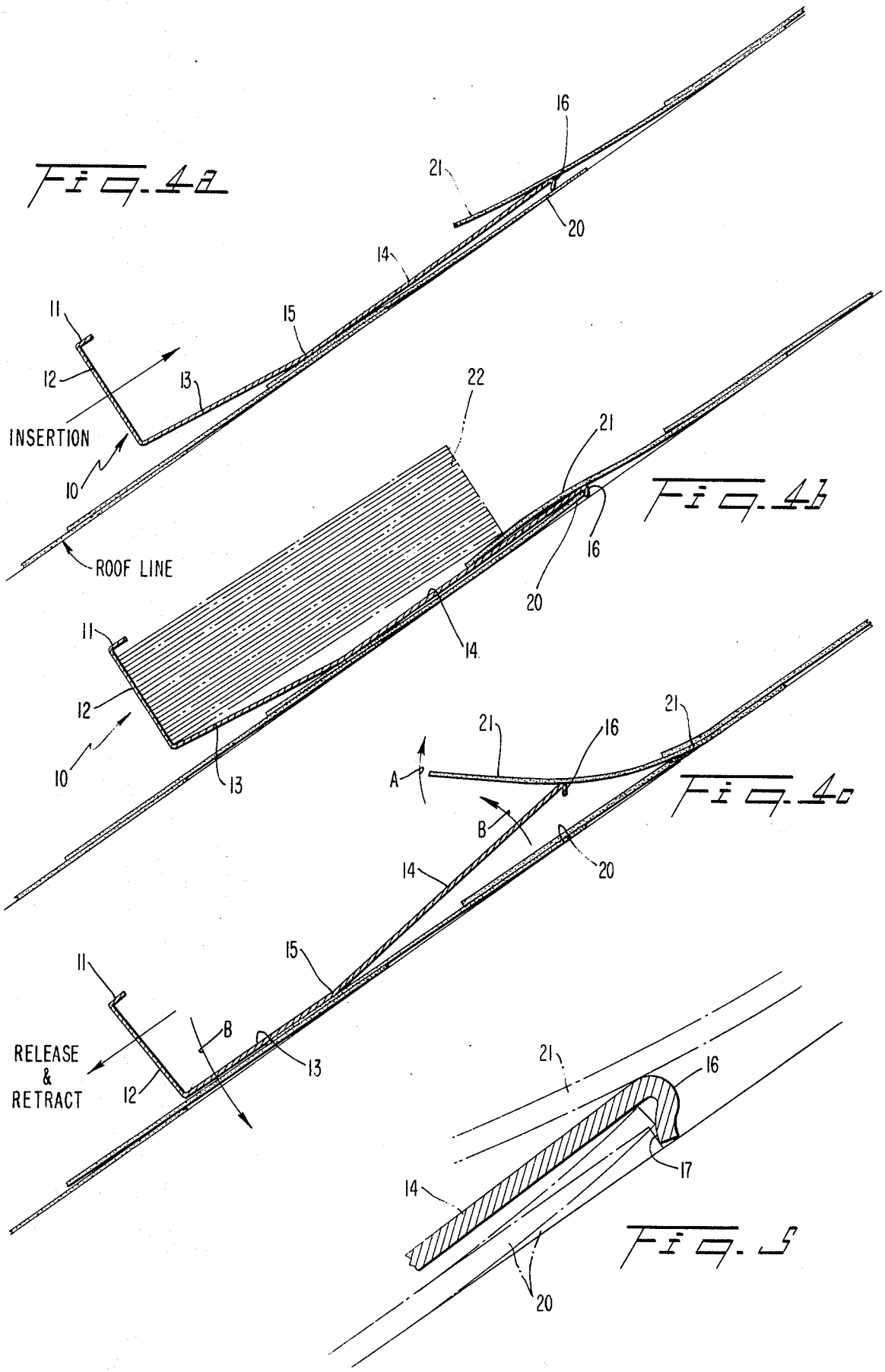
FIG. 5 is a fragmentary sectional view of the device during a releasing operation.

More specifically, referring to the drawings, the device, generally designated 10, comprises a single, continuous piece of material having five sections and four bends wherein each bend connects adjacent sections. The specific embodiment of this device includes a first end section 11, a base section 12, a back section 13, an insertion section 14 and a second end section 16. A first bend connects the first end section 11 and the base section 12. A second bend connects base section 12 and back section 13. A third bend 15 connects the back section 13 and the insertion section 14. A fourth bend connects the insertion section 14 and the second end section 16. Each of the sections are flat. The device 10 is shown inserted between successive lower course 20 and upper course 21 in FIG. 1. A bundle 22 of shingles is outlined thereby showing the function of device 10.

Referring to FIGS. 4*a* through 4*c*, the operation of device 10 is as follows. For insertion, the insertion section 14 has a structural configuration effective to slide between the successive lower and upper courses 20 and 21 of the shingles as shown. Device 10 is pushed upwardly far enough for the second end section 16 to hook downwardly over the top edge of the lower course 20. Thus, the insertion section 14 and second end section 16 constitute an attaching portion that is effective to fit between successive courses of roofing shingles fixed to the sloping roof. The second end section 16 is disposed at an angle with respect to the insertion section 14 and thus is effective to engage the top edge of the lower course 20 of the roof shingles. The shingle bundle 22 is disposed within the holding portion having a structural configuration to contain the shingles. The weight of the shingles holds the device 10 in position. The length of section 13 from bend 15 to the base 12 must be sufficient to maintain the center of gravity of the bundle 22 higher than the bend 15. Otherwise, the device 10 would rock about the bend 15 and thereby cause the second end section 16 to disengage from the top edge of the lower shingle course 20. In this specific embodiment the back section 13 is five inches long from the base 12 to the bend 15. The insertion section 14 is eight inches long from the bend 15 to the end thereof.

To remove device 10, the user simply pushes downwardly on a pushing surface forming a part of the flange 11 connected to the base section 12. This pushing surface could take many different kinds of forms. Upon pushing downwardly, the back section 13 and insertion section 14 each pivot about the bend 15 as shown by arrows A. The upper shingle course 21 moves upwardly in the direction of arrow A. In other words, when the first end section 11 is engaged by the user, the device is pushed toward the roof causing back section 13 to move toward the roof and the insertion section 14 to move away from the roof. This operation disengages the second end section 16 from the top edge of the lower shingle course 20. Upon disengagement, device 10 may then be retracted and relocated to the point at which the shingle nailing work is now being done on the roof.

A more detailed view of the action taking place at the top edge of shingle course 20 is shown in FIG. 5. The second end section 16 includes a cam surface 17 which faces the insertion section 14. As shown, the end flange or second end section 16 is disposed at an angle of less then 90°. The weight of shingle bundle 22 will undoubtedly cause a binding effect to occur between the top edge of shingle course 20 and the bent end section 16. Consequently, when the user pushes downwardly on flange 11 to pivot the device 10 about bend 15, there is a possibility of a shingle course 20 being lifted upwardly to some degree as shown in FIG. 5. The cam surface 17 makes it possible for this top edge to simply slide off and section 16 thereby effecting a smooth release for subsequent retraction of device 10 from between the lower course 20 and upper course 21 as described above.

The holding portion of the device 10 includes flange 11, base section 12 and back section 13. The shingle bundle 22 constitutes articles which are contained within the holding portion. This basic concept of the device may obviously be used for supporting other types of articles on a sloping roof. The configuration of the holding portion could be clearly adapted to any type of article including working implements, scaffolding and the like.

While the article holder for a sloping roof has been shown and described in detail, it is obvious that this invention is not to be considered as being limited to the exact form disclosed, and that changes in detail and construction may be made therein within the scope of the invention, without departing from the spirit thereof.

Having thus set forth and disclosed the nature of this invention, what is claimed is:

1. A device for holding articles on a sloping roof comprising:

a. a holding portion having a structural configuration to contain said articles, b. an attaching portion including an insertion section having a structural configuration effective to slide between successive courses of roofing shingles fixed to said roof, c. said attaching portion including a bent end flange effective to hook downwardly over the top edge of the lower course of said successive courses of shingles when the insertion section is inserted therebetween, and d. means for disengaging the bent end flange from said top edge to cause the insertion section to move away from said roof when the holding portion is pushed toward said roof.

2. A device as defined in claim 1 wherein said attaching portion comprises a first flat section, and said holding portion includes a second flat section connected to and at an angle along one edge of said fist flat section forming a bend.

3. A device as defined in claim 1 wherein said holding portion has an L-shaped cross section having a bottom base section for holding a stack of shingles and an end flange extending from the base section in a direction toward the other end of the device.

4. A device as defined in claim 1 wherein said attaching portion comprises a flat section having a free top edge, said bent end flange being disposed at an angle of less than 90° with respect to said flat attaching section.

5. A device as defined in claim 4 wherein said bent end flange includes a cam surface facing said flat attaching section.

6. A device for holding a bundle of shingles on a sloping roof, said device comprising:

a. a first end section, a base section, a back section, an insertion section and a second end section, b. said back section and said insertion section being disposed at an angle with respect to each other so that the back section projects outwardly from said sloping roof, c. said insertion section including a structural configuration effective to slide between successive lower and upper courses of shingles fixed on said roof, d. said second end section being disposed at an angle with respect to the insertion section and being effective to engage a top edge of said lower course of shingles, e. said first end section being engageable by the user to push toward said roof causing the back section to move toward said roof and the insertion section to move away from said roof for disengaging the second end section from said top edge of the lower course of shingles.

7. A device in claim 6 wherein said sections form one continuous piece of material having four bends, a first end connects the first end section and the base section, a second bend connects the base section and the back section, a third bend connects the back section and the insertion section and a fourth bend connects the insertion section and the second end section.

8. A device as defined in claim 6 wherein the second end section has a cam surface facing toward the insertion section.

9. A device as defined in claim 6 wherein the first end section comprises a pushing surface.

10. A device as defined in claim 9 wherein said pushing surface is on a flange connected to the base section.

11. A device for holding articles on a sloping roof comprising:

a. a holding portion having a structural configuration to contain said articles, b. an attaching portion being effective to fit between successive courses of roofing shingles fixed to said roof, c. said attaching portion including a bent end flange effective to hook downwardly over the top edge of the lower course of said successive courses of shingles, d. said attaching portion comprises a first flat section, and e. said holding portion includes a second flat section connected to and at an angle along one edge of said first flat section forming a bend.

12. A device for holding articles on a sloping roof comprising:

a. a holding portion having a structural configuration to contain said articles, b. an attaching portion being effective to fit between successive courses of roofing shingles fixed to said roof, c. said attaching portion including a bent end flange effective to hook downwardly over the top edge of the lower course of said successive courses of shingles, d. said attaching portion comprises a flat section having a free top edge, e. said bent end flange being disposed at an angle of less than 90° with respect to said flat attaching section.

* * * * *